US007625234B1

(12) United States Patent
Lee et al.

(10) Patent No.: US 7,625,234 B1
(45) Date of Patent: Dec. 1, 2009

(54) ELECTRICAL CONNECTOR

(75) Inventors: Kuo-Chi Lee, Taipei County (TW); Chin-Huang Lin, Taipei County (TW)

(73) Assignee: Dragonstate Technology Co., Ltd., Taipei (TW)

( * ) Notice: Subject to any disclaimer, the term of this patent is extended or adjusted under 35 U.S.C. 154(b) by 0 days.

(21) Appl. No.: 12/363,939

(22) Filed: Feb. 2, 2009

(30) Foreign Application Priority Data

Dec. 26, 2008 (TW) ..... 97223334 U

(51) Int. Cl.
*H01R 13/648* (2006.01)

(52) U.S. Cl. ..... 439/607.07

(58) Field of Classification Search ..... 439/607.07, 439/607.13, 607.32
See application file for complete search history.

(56) References Cited

U.S. PATENT DOCUMENTS 6,368,167 B1 * 4/2002 Ma et al. ..... 439/607.01
6,588,100 B2 * 7/2003 Ma et al. ..... 29/882
6,986,681 B2 * 1/2006 Tsai ..... 439/607.36
7,094,103 B2 * 8/2006 Lai ..... 439/607.45

* cited by examiner

*Primary Examiner*—Briggitte R Hammond
(74) *Attorney, Agent, or Firm*—Rosenberg, Klein & Lee

(57) ABSTRACT

An electrical connector includes a plurality of terminals, and a module member having a front end face, a rear end face and a bottom side interconnecting the front and rear end faces. The bottom side is dented inwardly to form an assembling chamber. The front end is dented inwardly to form a front opening in spatial communication with the assembling chamber. An insulated main body includes a base portion inserted into the assembling chamber in the module member, and a tongue plate projecting frontward from the base portion. Each terminal has a contact section embedded in the tongue plate via an insert-molding process and an inclined section extending from the contact section. A metal shell encloses the module member from an exterior thereof.

10 Claims, 8 Drawing Sheets

1000

ELECTRICAL CONNECTOR

This application claims the benefits of the Taiwan Patent Application Serial NO. 097223334, filed on Dec. 26, 2008, the subject matter of which is incorporated herein by reference.

BACKGROUND OF THE INVENTION

1. Field of the Invention

The present invention relates to an electrical connector, more particularly to an electrical connector with a modular design.

2. Description of the Prior Art

Most of PCs (personal computer), TV sets and electronic devices have an outer casing provided with built-in electrical connector for electrical connection with a peripheral device (such as DVD player) to facilitate signal transmission therebetween.

Referring to FIG. 1, a conventional electrical connector 100*a* is shown to include a metal shell 130*a*, an insulated main body 110*a*, and a plurality of terminals 120*a*. The insulated main body 110*a* is formed with a plurality of retention holes 111*a*. The terminals 120*a* are inserted respectively into the retention holes 111*a* in the insulated main body 110*a*. Afterward, the insulated main body 110*a* is inserted into the metal shell 130*a*, thereby completing assembling of the conventional electrical connector 100*a*.

In case the terminals 120*a* are not aligned with one another along a horizontal plane at an initial condition (i.e. prior to inserting into the main body 11*a*), collision of the terminals 120 against the peripheral walls defining the retention holes 111*a* respectively during the insertion may result in partial bending of the terminals and hence disqualified product after assembly, which must be discarded, thereby occurring an extra manufacture expense.

Moreover, the metal shell 130*a* is usually fabricated according to different designs and different specifications, and has a structure differ from one another. In case, the dimension or design of the metal shell 130*a* is abruptly changed, the finished insulated main body 110*a* is unable to complement with the metal shell 130*a*. The finished insulated main body 110*a* and the metal shell 130*a* must be discarded. To open a new mold for fabricating a required insulated main body will cause extra expense for the manufacturers.

SUMMARY OF THE INVENTION

Therefore, the object of the present invention is to provide an electrical connector of modular type having a modular member and an insulated main body, wherein the modular member can be designed to complement with different types of metal shell. The terminals are mounted to the insulated main body via an insert-molding process such that the terminals are arranged in neat and uniform manner, thereby precisely maintaining the proper positions of the terminals so as to avoid the problems encountered in the prior art electrical connector.

The electrical connector of modular type according to the present invention includes a module member, an insulated main body, a plurality of terminals and a metal shell.

The module member has a front end face extending along an assembling direction, a rear end face opposite to the front end face and a bottom side interconnecting the front and rear end faces. The bottom side is dented inwardly to form an assembling chamber adjacent to the front end face. The front end face is dented inwardly to form a front opening in spatial communication with the assembling chamber.

The insulated main body includes a base portion inserted into the assembling chamber in the module member, a tongue plate projecting frontward from the base portion along an extending direction transverse to the assembling direction.

Each terminal has a contact section embedded in the tongue plate via an insert-molding process and an inclined section extending from one end of the contact section. The metal shell encloses the module member from an exterior thereof.

Since the module member can be altered with the assistance of the insulated main body so as to complement with the metal shell of different specification, the abrupt changing of the metal shell encountered in the prior art can be avoided. Discarding of the half-finished assembly of the insulated main body and the terminals is also avoided. In addition, since terminals are partially embedded in the insulated main body in advance, a relatively large assembling time can be minimized.

In the electrical connector of the present invention, the insert-molding process is used to embed the terminals partially in the insulated main body in advance so that the entire terminals are arranged in neat and uniform manner so as to avoid the problems, such as terminal bending and discarding of the insulated main body, encountered in the prior art electrical connector.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
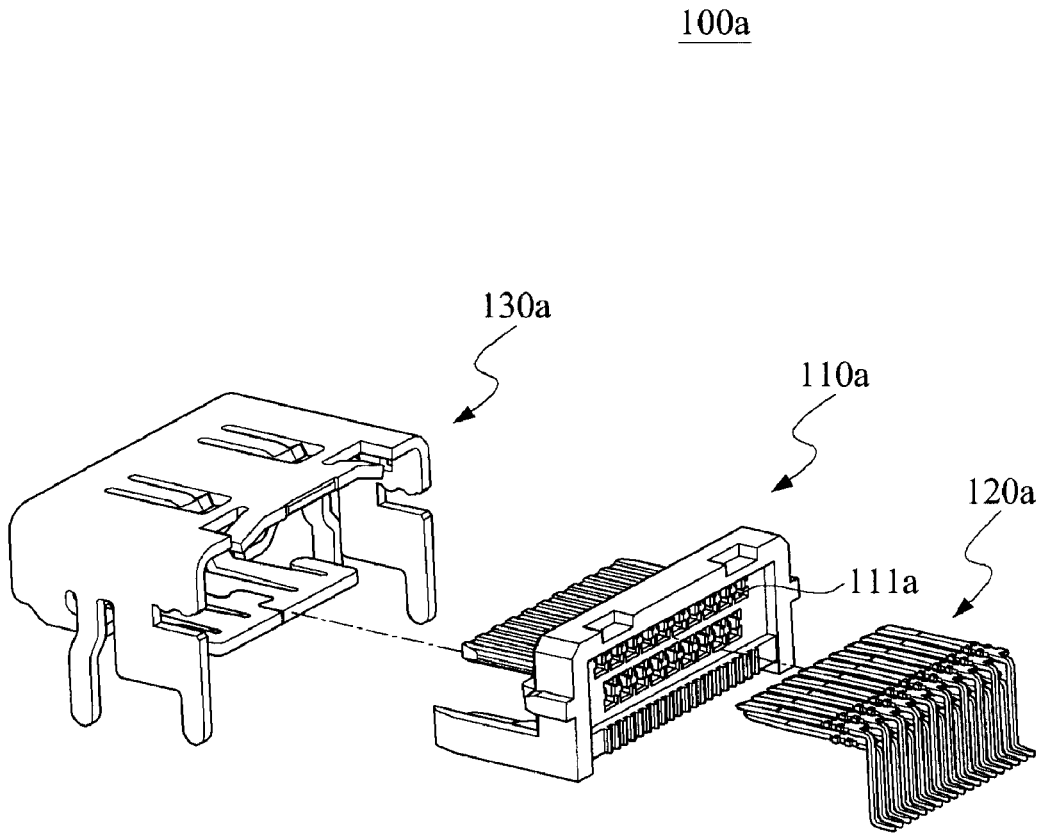
FIG.1(Prior Art)
FIG. 1 is an exploded and perspective view of a conventional electrical connector.
Figure 2:
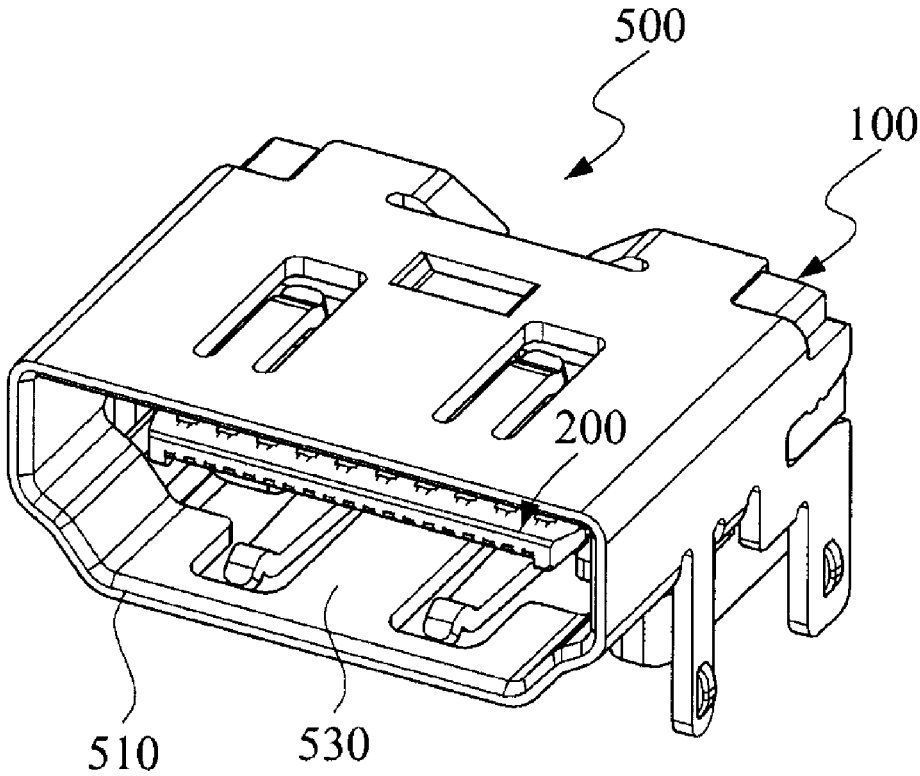
FIG. 2 is a perspective view of an electrical connector of the present invention.
Figure 3:
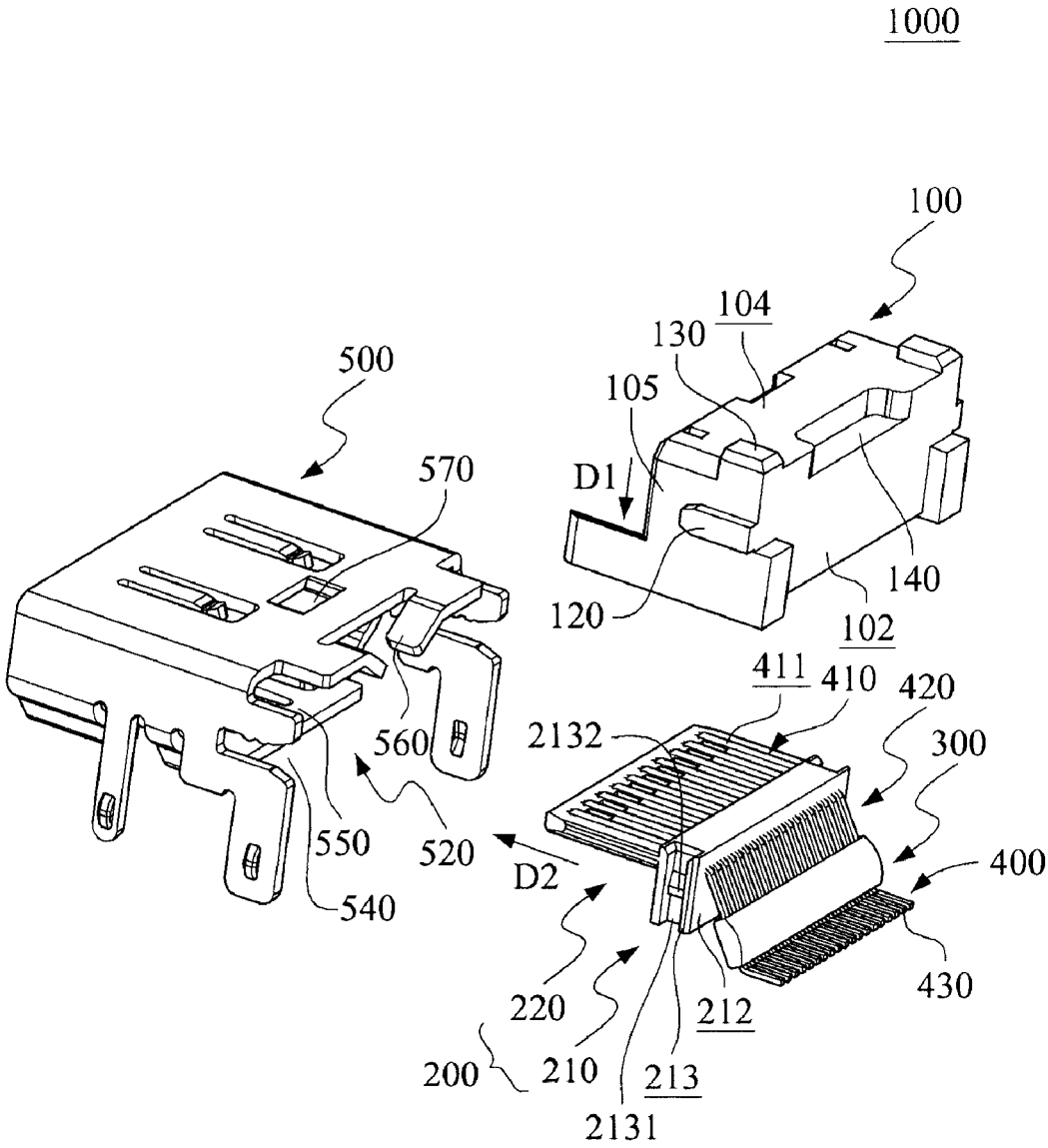
FIG. 3 is an exploded and perspective view of the electrical connector of the present invention.
Figure 4:
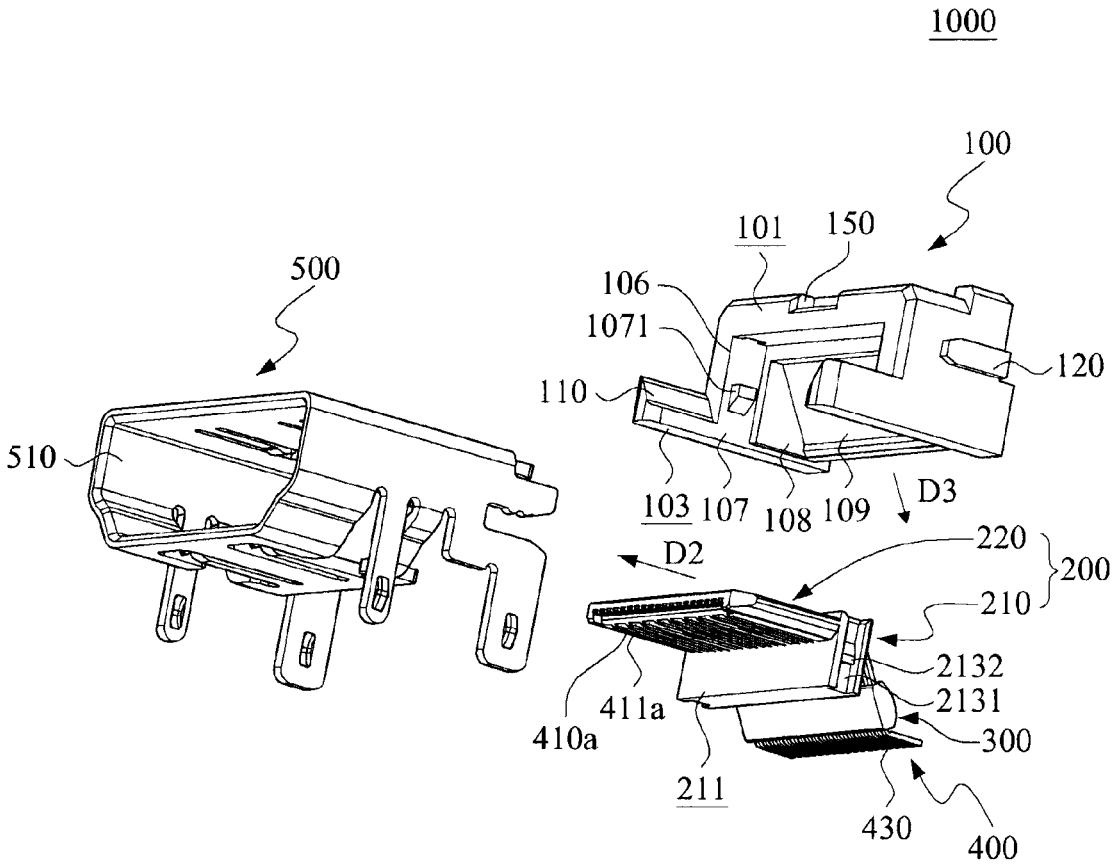
FIG. 4 illustrates assembling of the components for forming the electrical connector of the present invention.

FIG. 2 is a perspective view of an electrical connector of the present invention. FIG. 3 is an exploded and perspective view of the electrical connector of the present invention. FIG. 4 illustrates assembling of the components for forming the electrical connector of the present invention. The electrical connector 1000 accordingly includes an insulated main body 200, a positioning member 300, a terminal set consisting of a plurality of terminals 400, a module member 100 and a metal shell 500.

The module member 100 is made from dielectric materials, and is produced by extrusion means. The module member 100 has a front end face 101 extending along an assembling direction D1, a rear end face 102 opposite to the front end face 101, bottom and top sides 103, 104 interconnecting the front and rear end faces 101, 102, and two lateral sides 105 interconnecting the front and rear end faces 101, 102. The bottom side 103 is dented inwardly to form an assembling chamber 107 adjacent to the front end face 101. The front end face 101 is dented inwardly to form a front opening 106 in spatial communication with the assembling chamber 107. The bottom side 103 of the module member 100 is further dented inwardly to form a retention chamber 108 adjacent to the rear end face 102. The retention chamber 108 is in spatial communication with the assembling chamber 107. The retention chamber 108 has an innermost wall 109 extending from the bottom side 103 along an oblique direction D3 inclined with respect to the assembling direction D1.

The module member 100 further has a pair of auxiliary arms 110, first and second pair of limiting blocks 120, 130 and first and second recesses 140, 150.

The auxiliary arms 110 extend forward from the front end face 101 of the module member 100 along the extending direction D2. The first limiting blocks 120 are formed two lateral sides 105 of the module member 100, extends along the extending direction D2. The second limiting blocks 130 are formed at an adjoining position of the top side 104 and the lateral sides 105, extends along the extending direction D2. The first recess 140 is formed at an adjoining position of the top side 104 and the rear end face 102 while the second recess 130 is formed at an adjoining position of the top side 104 and the front end face 101.

The insulated main body 200 includes a base portion 210 and a tongue plate 220. The base portion 210 has a front end face 211, a rear end face 212 opposite to the front end face 211, and two lateral sides 213 interconnecting the front and rear end faces 211,212. The front and rear end faces 211, 212 extend along the assembling direction D1. Each lateral side 213 of the insulated main body 200 is dented inwardly to form a guide channel 2131. The guide channel 2131 has an inner wall confining the bottom side and formed with an engagement block 2132. The tongue plate 220 projects frontward from the front end face 211 of the base portion 210 along the extending direction D2.

When the insulated main body 200 is assembled to the module member 100, the base portion 210 is received in the assembling chamber 107 while the engagement blocks 2132 of the insulated main body 200 respectively engage with the engagement blocks 1071 fixed on two lateral side walls of the assembling chamber 107, thereby preventing disengagement of the insulated main body 200 from the module member 100.

The positioning member 300 is fabricated by extrusion means and is received in the retention chamber 108 in the module member 100. Once assembled to the module member 100, the position member 300 abut against an innermost wall 109 in the retention chamber 108, wherein the innermost wall 109 extends from the bottom side 103 along an oblique direction D3 inclined with respect to the assembling direction D1. The position member 300 assists mounting of the terminals 400 as explained in the following.

Each terminal 400 has a contact section 410 embedded in the tongue plate 220 via an insert-molding process, an inclined section 420 and a mounting section 430. The contact section 410 of each terminal 400 has a contact surface 411 exposed from one side of the tongue plate 220. In this embodiment, the terminal set includes a plurality of first terminals and a plurality of second terminals, each being disposed between adjacent two of the first terminals. The contact surfaces 411 of the contact sections 410 in the first terminals are exposed from a bottom side of the tongue pate 220 while the contact surfaces 411*a* of the contact sections 410*a* in the second terminals are exposed from an upper side of the tongue plate 220. Note that the contact sections 410 of the first terminals in the upper row are staggered relative to the contact sections 410*a* of the second terminals in the lower row and are partially embedded in the tongue plate 220, thereby exposing the contact surfaces 411, 411*a* to an exterior thereof.

The inclined section 420 extends from one end of the contact section 410 along the oblique direction D3 inclined with respect to the assembling direction D2. The inclined section 420 has at least one strip embedded within the positioning member 300 via the insert-molding process.

The contact section 410 and the inclined section 420 of each of the terminals 400 cooperatively define a blunt angle at an adjoining position thereof. The blunt angle formed accordingly provides better data transmission ability when compared to the perpendicularly bent terminal of the prior art. Later, the contact section 410 and the inclined section 420 of each terminal are bent to a desired angle according to the requirement of the different standards and designs.

The mounting section 430 extends from one end of the inclined section 420. The inclined section 420 and the mounting section 430 of each of the terminals 400 cooperatively define a blunt angle at an adjoining position thereof. The blunt angle formed accordingly provides better data transmission ability when compared to the perpendicularly bent terminal of the prior art.

The metal shell 500 encloses the insulated main body 200 from above. The metal shell 500 is made by punching and simultaneously bending a metal plate. The metal shell 500 has a front open end 510 and a rear open end 520. Once the insulated main body 200 is inserted into the metal shell 500, a plug-reception chamber 530 (see FIG. 2) is defined between the tongue plate 220 and the metal shell 500. A plug of an external electrical connector (not shown) can be inserted into the plug-reception chamber 530 of the present electrical connector 1000.

The metal shell 500 is a hollow body having a pair of first engaging slots 540 at two lateral sides and long the extending direction D2 for receiving the first limiting blocks 120 of the module member 100 when the latter is inserted into the former while the auxiliary arms 110 engage tightly with an outer peripheral wall of the metal shell 500, thereby preventing untimely removal of the module member 100 from the metal shell 500. The metal shell 50 further has a pair of second engaging slots 550 formed at adjoining positions of the top and lateral sides for receiving the second limiting blocks 130 of the module member 100.

The metal shell 500 further has a first pair of limiting ribs 560 adjacent to the rear opening 520 and a second pair of limiting ribs 570 for engaging the first and second recesses 140, 150 in the module member 100 when the latter is inserted into the former.

Figure 5:
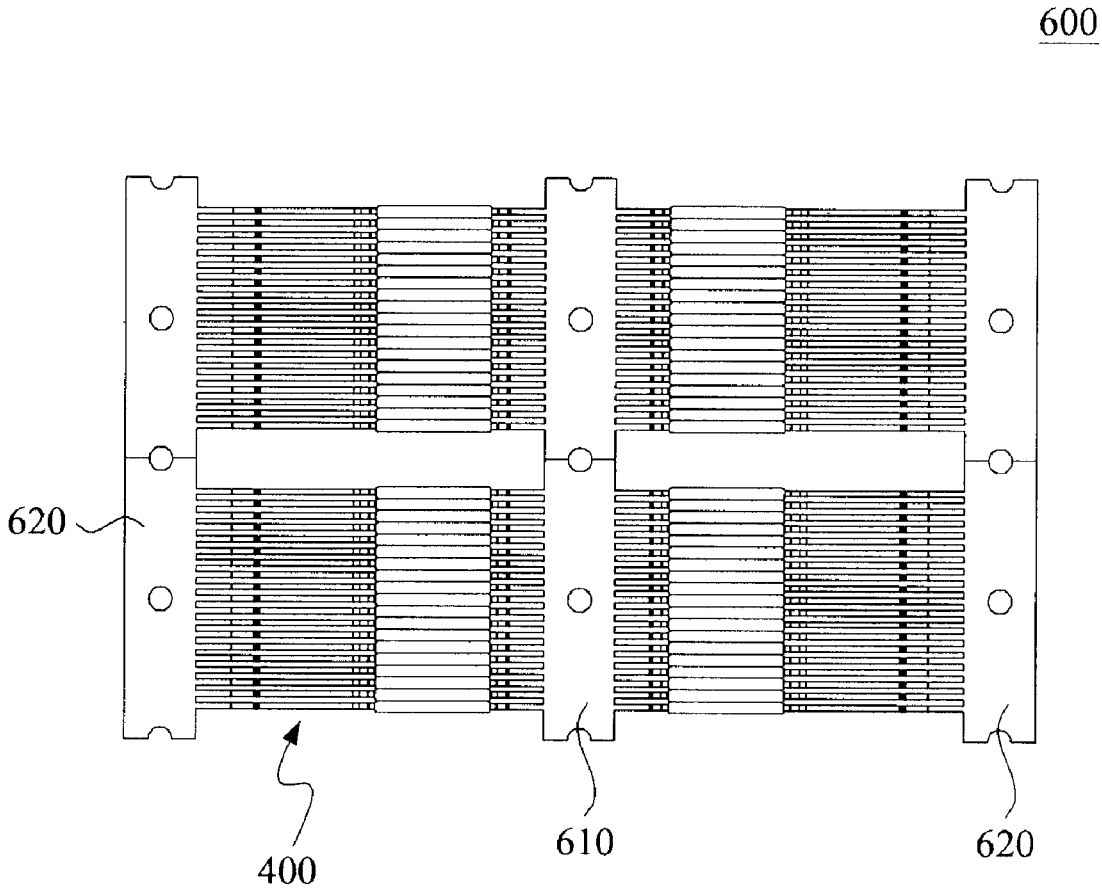
FIG. 5 is a top view illustrating a metal plate for forming a terminal set employed in the electrical connector of the present invention.
Figure 6:
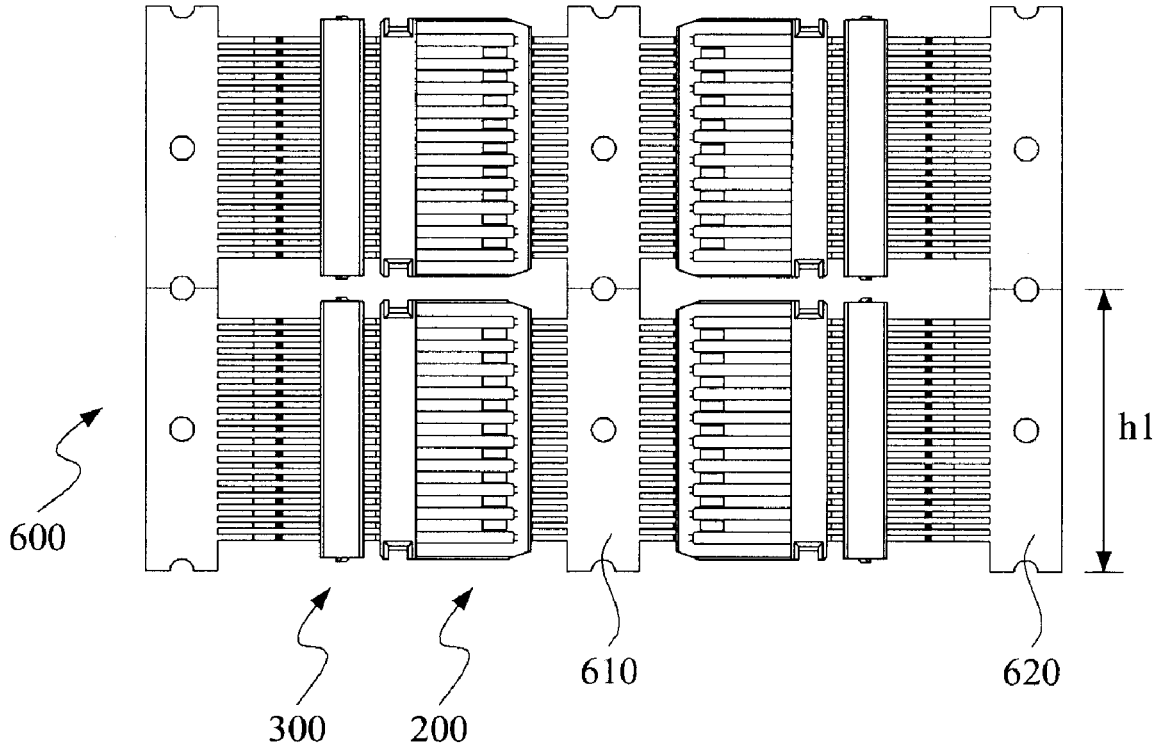
FIG. 6 shows the terminal set of FIG. 5 embedded partially into an insulated main body and a positioning member via an insert-molding process during production of the electrical connector of the present invention.

FIG. 5 is a top view illustrating a metal plate 600 for forming the terminal set employed in the electrical connector of the present invention, wherein the terminals 400 are formed by punching, bending and cutting the metal plate 600. The metal plate 600 includes a middle strip 610, a plurality of the terminals 400 at two sides of the middle strip 610 and two distal end strips 620.

After the terminals 400 are embedded into the positioning member 300 and/or the insulated main body 200 via the insert-molding process, the distal end strips 620 are cut off leaving only the middle strip 610. In order to achieve the desired terminal set for employing in the electrical connector of the present invention, the distal end strip 610, 620 of each terminal set should have a vertical length smaller than h1, which is slightly smaller that the longitudinal length of the insulated main body 200.

Figure 7:
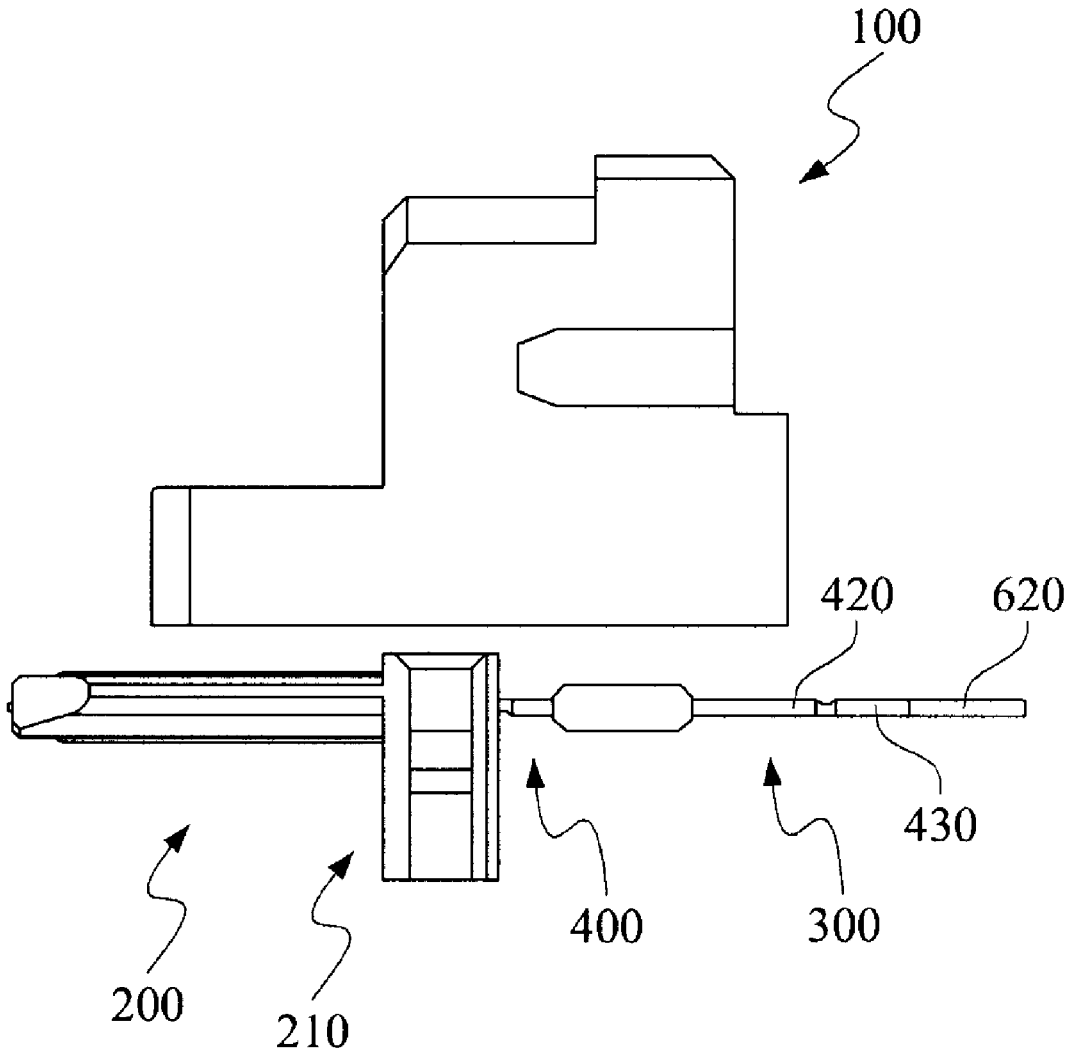
FIGS. 7 and 8 respectively illustrate assembling of a module member and the insulated main body and the positioning member during production of the electrical connector of the present invention.

FIG. 7 illustrates assembling of the module member 100 and the insulated main body 200, wherein the terminals 400 are not yet bent and the distal end strip 620 is not cut off. The module member 100 is pressed downward along the assembling direction D1 so as to receive the insulated main body 200 in the assembling chamber 107 (see FIG. 4), which action causes bending of the inclined section 420 and the mounting section 430.

Figure 8:
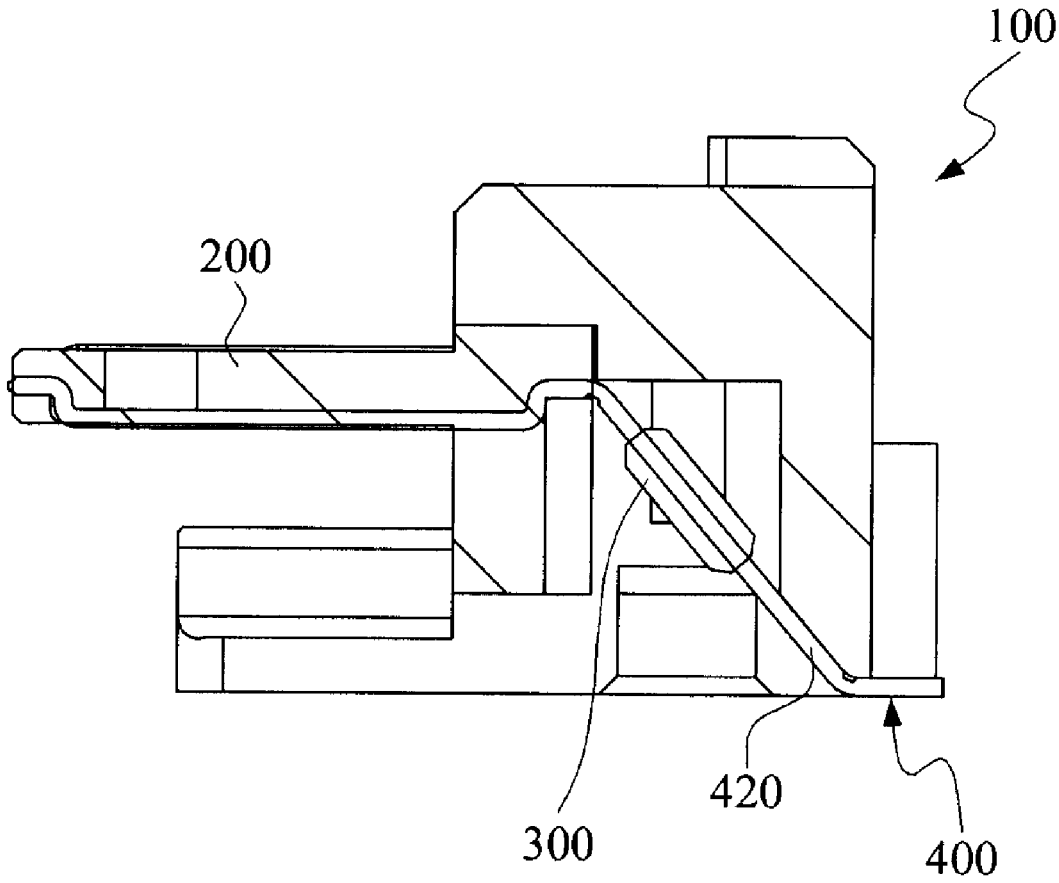

Finally, the distal end strips 610, 620 are not cut off, thereby obtaining the finished product (the electrical connector) as shown in FIG. 8. At this time, since the inclined sections 420 of the terminals 400 are compressed tightly by the module member 100, a stress is present between the inclined sections 420 and the module member 100, thereby providing neat, uniform spacing and alignment among the terminals 400.

Note that the terminals 400 are mounted to the positioning member 300 and the insulated main body 200 via the insert-molding process such that the terminals 400 become part of the final product and later the distal end strips 610, 620 are cut off to provide uniform spacing and alignment among the terminals 400.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector comprising:

a module member having a front end face extending along an assembling direction, a rear end face opposite to said front end face and a bottom side interconnecting said front and rear end faces, said bottom side being dented inwardly to form an assembling chamber adjacent to said front end face, said front end face being dented inwardly to form a front opening in spatial communication with said assembling chamber;

an insulated main body including a base portion inserted into said assembling chamber in said module member, and a tongue plate projecting frontward from said base portion along an extending direction transverse to said assembling direction;

a plurality of terminals, each having a contact section embedded in said tongue plate via an insert-molding process and an inclined section extending from one end of said contact section; and a metal shell enclosing said module member from an exterior thereof.

2. The electrical connector according to claim 1, further comprising a positioning member, said inclined section of each of said terminals having at least one strip embedded within said positioning member via the insert-molding process.

3. The electrical connector according to claim 1, wherein said bottom side of said module member is further dented inwardly to form a retention chamber adjacent to said rear end face, said retention chamber being in spatial communication with said assembling chamber.

4. The electrical connector according to claim 3, wherein said retention chamber has an innermost wall extending from said bottom side along an oblique direction inclined with respect to said assembling direction.

5. The electrical connector according to claim 4, wherein said inclined sections of said terminals extend along said oblique direction and are received in said retention chamber once said insulated main body is coupled to said module member.

6. The electrical connector according to claim 3, further comprising a positioning member received within said retention chamber in said module member, said inclined section of each of said terminals having at least one strip embedded within said positioning member via the insert-molding process.

7. The electrical connector according to claim 1, wherein said contact section of each of said terminals has a contact surface exposed from said tongue plate.

8. The electrical connector according to claim 1, wherein each of said terminals further has a mounting section extending from one end of said inclined section and located at an adjoining position between said bottom side and said rear end face of said module member.

9. The electrical connector according to claim 1, wherein said module member further has a pair of auxiliary arms extending forward from said front end face along said extending direction to engage tightly with an outer peripheral wall of said metal shell, thereby preventing untimely removal of said module member from said metal shell.

10. The electrical connector according to claim 1, wherein said module member further has a pair of first engagement blocks respectively fixed on two lateral side walls of said assembling chamber, said insulated main body further including a pair of second engagement blocks respectively fixed on two lateral sides of said base portion for engaging said first engagement blocks once said base portion is inserted into said assembling chamber in said module member.

* * * * *